US008905868B2

(12) United States Patent
Quinn

(10) Patent No.: US 8,905,868 B2
(45) Date of Patent: Dec. 9, 2014

(54) SPORT RELATED TRAINING APPARATUS

(76) Inventor: Patrick Joseph Quinn, Markham (CA)

( * ) Notice: Subject to any disclaimer, the term of this patent is extended or adjusted under 35 U.S.C. 154(b) by 207 days.

(21) Appl. No.: 13/335,840

(22) Filed: Dec. 22, 2011

(65) Prior Publication Data

US 2012/0157242 A1 Jun. 21, 2012

Related U.S. Application Data

(63) Continuation-in-part of application No. 12/895,038, filed on Sep. 30, 2010, now Pat. No. 8,357,061.

(51) Int. Cl.

| | |
|---|---|
| ***A63B 69/00*** | (2006.01) |
| ***A63B 5/22*** | (2006.01) |
| *A63B 69/34* | (2006.01) |
| *A63B 59/14* | (2006.01) |
| *A63B 63/00* | (2006.01) |
| *A63B 63/06* | (2006.01) |
| *A63B 71/02* | (2006.01) |

(52) U.S. Cl.

CPC . *A63B 5/22* (2013.01); *A63B 69/34* (2013.01); *A63B 2225/09* (2013.01); *A63B 2243/0033* (2013.01); *A63B 69/0026* (2013.01); *A63B 59/14* (2013.01); *A63B 2063/002* (2013.01); *A63B 63/06* (2013.01); *A63B 2210/50* (2013.01); *A63B 2071/024* (2013.01); *A63B 69/002* (2013.01); *A63B 63/00* (2013.01)

USPC ..... 473/446; 473/422; 473/438

(58) Field of Classification Search

USPC ..... 473/422, 446, 438, 471, 476, 477; 482/50–54

See application file for complete search history.

(56) References Cited

U.S. PATENT DOCUMENTS

| | | | |
|---|---|---|---|
| 2,354,050 | A | 7/1944 | Paupa |
| 3,955,815 | A | 5/1976 | Deschesnes |
| 4,070,017 | A | 1/1978 | Lombardi |
| 4,607,842 | A | 8/1986 | Daoust |
| 5,161,799 | A | 11/1992 | Nandra |
| 5,226,821 | A | 7/1993 | Murphy et al. |
| 5,362,045 | A | 11/1994 | Hammett et al. |
| 5,620,404 | A | 4/1997 | Eyman |
| 5,769,742 | A | 6/1998 | Bristow |
| 5,807,185 | A | 9/1998 | Raubuck et al. |
| 6,012,994 | A | 1/2000 | Beluse |
| 6,090,015 | A | 7/2000 | Meyers |
| 6,099,420 | A | 8/2000 | Nandra |
| 6,132,338 | A | 10/2000 | Shifferaw |
| 6,165,084 | A | 12/2000 | Cranston |
| 6,921,339 | B1 | 7/2005 | Martin |
| 6,926,624 | B1 | 8/2005 | Witzke |
| 6,926,643 | B1 | 8/2005 | Gvoich |
| 7,850,576 | B2 | 12/2010 | Sellke |
| 7,905,800 | B2 | 3/2011 | Oneschuk |
| 2003/0096666 | A1 | 5/2003 | Zielinski |
| 2006/0063615 | A1 | 3/2006 | Richardson et al. |
| 2008/0287224 | A1 | 11/2008 | Salvador et al. |

FOREIGN PATENT DOCUMENTS

| | | | |
|---|---|---|---|
| CA | 1 305 731 | A | 7/1992 |
| CA | 2 339 869 | A1 | 7/2002 |

*Primary Examiner* — Mitra Aryanpour
(74) *Attorney, Agent, or Firm* — Pearne & Gordon LLP

(57) ABSTRACT

A training apparatus for use on a training surface is disclosed. The training apparatus includes a sport-projectile stopping member and an elongated body substantially transverse to the sport-projectile stopping member. The elongated body has a first section, a second section, and a transition section between the first and second sections. A portion of the first section is positioned on the sport-projectile stopping member, and the first section is sized such that the sport-projection stopping member, the first section, the training surface and the transition section define an orifice through which a sport-projectile can pass through.

24 Claims, 13 Drawing Sheets

16

SPORT RELATED TRAINING APPARATUS

TECHNICAL FIELD

The present invention relates to a training apparatus and, more particularly, to a training apparatus for use on a training surface.

BACKGROUND

Sports players require a range of skills that must be continually refined to become great players. Most, if not all, sports use a form of projectile such as a ball, puck or ring. Some sports restrict the handling of such projectile to hand (e.g. handball) or feet (e.g. soccer), while in other sports, the player must use a stick to manipulate the projectile (e.g. hockey, lacrosse or ringette). Moreover, in some sports, the game is played on an unfamiliar surface, which requires the player to learn an additional skill that is fundamental to the sport.

In sports where a stick is used to manipulate the projectile, in addition to the level of fitness and strength required by all athletes, the player must have good stick control. Most conventional training devices concentrate on these skills. For example, the training device in Murphy (U.S. Pat. No. 5,226,821) concentrates primarily on puck control for hockey players. Similarly, Maki (Canadian Patent No. 1,305,731) is for improving puck handling skills. Other conventional training devices concentrate on developing related skills such as shooting and/or passing (Witzke, U.S. Pat. No. 6,926,624; Hammett, U.S. Pat. No. 5,362,045; and, Cranston, U.S. Pat. No. 6,165,084).

While good stick control, shooting and passing skills are the basis for a good player, a great player possesses many more skills that must be developed and continually refined. Where the sport is played on an unfamiliar surface such as ice, there are many more variables in the equation to becoming a great player. For example, in the sport of hockey and ringette played on ice (both sports may be played on other surfaces), the player requires great skating skills, balance, agility and weight distribution in addition to all the other fundamental skills. Conventional training devices lack such training and thus, there is a need for a training device that develops a broader range of skills and physicality in such players.

SUMMARY

In accordance with the present disclosure there is provided a training system comprising a support member comprising a support for supporting the support member on a surface when in use; an elongate obstacle member arranged with the support member when in use, the obstacle member comprising a first section proximate to a first end and coupled to the support member when in use; a second end opposite the first end; and a pass-under section, arranged between the first end and the second end, defined by a lower surface of the obstacle member supported above the surface by a height sufficient to allow a sport-projectile to pass between the surface and the lower surface of the obstacle member when in use. The training system further comprises a mount located on the support member or the obstacle member; and an adjustment surface supported by the mount when in use, the adjustment surface, when supported by the mount, extending away from the lower surface towards the surface over at least a portion of the pass-under section and changing a usable length of the pass-under section that the sport-projectile may pass under.

In accordance with the present disclosure there is further provided a training apparatus comprising a support member comprising a support for supporting the support member on a surface when in use; an elongate obstacle member arranged with the support member when in use, the obstacle member comprising a first section proximate to a first end and coupled to the support member when in use; a second end opposite the first end; and a pass-under section, arranged between the first end and the second end, defined by a lower surface of the obstacle member supported above the surface by a height sufficient to allow a sport-projectile to pass between the surface and the lower surface of the obstacle member when in use. The training apparatus further comprising a mount located on the support member or the obstacle member for supporting an adjustment surface to change a usable length of the pass-under section that the sport-projectile may pass under.

In accordance with the present disclosure there is further provided a kit for a training system comprising: a support member comprising a support for supporting the support member on a surface when in use; an elongate obstacle member arranged with the support member when in use, the obstacle member comprising a first section proximate to a first end and coupled to the support member when in use; a second end opposite the first end; and a pass-under section, arranged between the first end and the second end, defined by a lower surface of the obstacle member supported above the surface by a height sufficient to allow a sport-projectile to pass between the surface and the lower surface of the obstacle member when in use. The kit further comprises an adjustment surface; and a mount for supporting the adjustment surface to change a usable length of the pass-under section that the sport-projectile may pass under.

BRIEF DESCRIPTION OF THE DRAWINGS

These and other features of the invention will become more apparent from the following description in which reference is made to the appended drawings wherein.

DETAILED DESCRIPTION

While the present disclosure is described in conjunction with the specific embodiments, it will be understood that it is not intended to limit the patent disclosure to the described embodiments. On the contrary, it is intended to cover alternatives, modifications, and equivalents as may be included within the scope of the patent disclosure as defined by the appended claims. In the above description, numerous specific details are set forth in order to provide a thorough understanding of the present patent disclosure. The present patent disclosure may be practiced without some or all of these specific details.

In this specification and the appended claims, the singular forms "a," "an," and "the" include plural references unless the context clearly dictates otherwise. Unless defined otherwise, all technical and scientific terms used herein have the same meaning as commonly understood to one of ordinary skill in the art to which this invention belongs.

It will be further understood that the terms "comprises" or "comprising", or both when used in this specification, specify the presence of stated features, integers, steps, operations, elements, and/or components, but do not preclude the presence or addition of one or more other features, integers, steps, operations, elements, components, and/or groups thereof.

Figure 1:
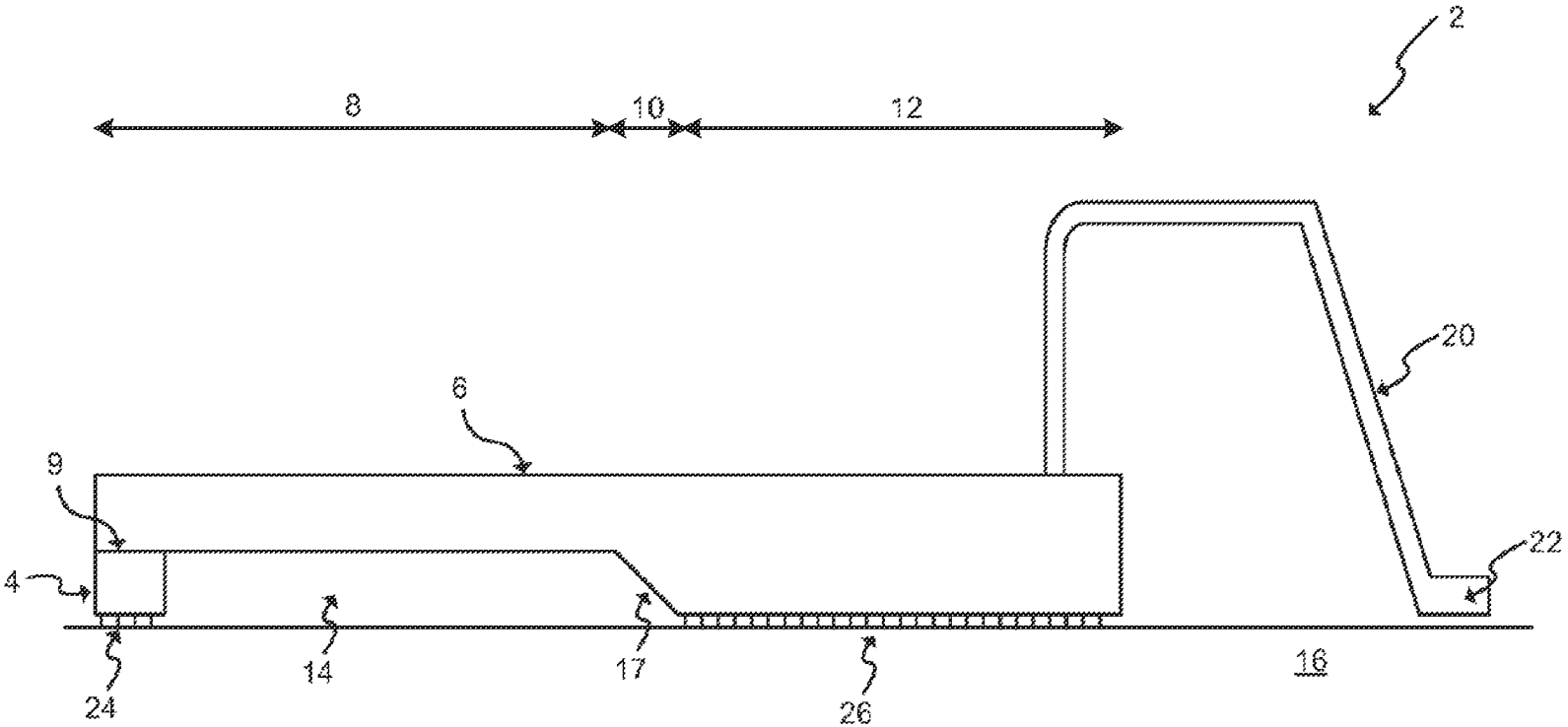
FIG. 1 shows a side view of an embodiment of the present invention.
Figure 2:
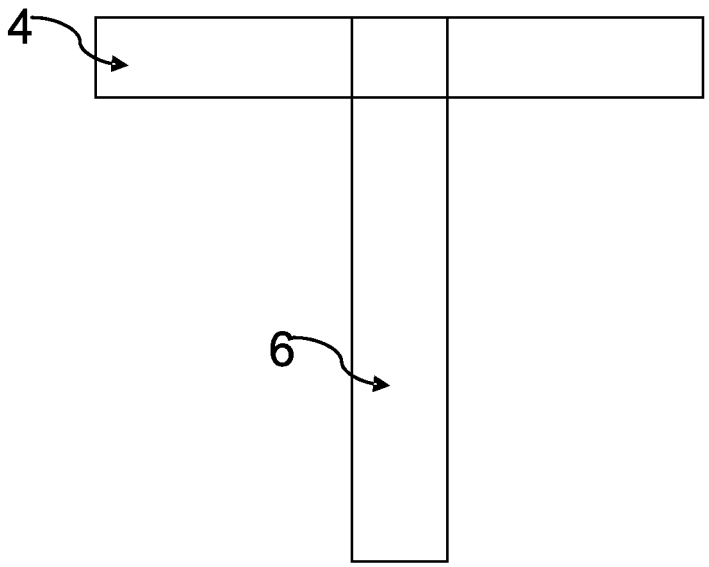
FIG. 2 shows a top view of an embodiment of the present invention.
Figure 3:
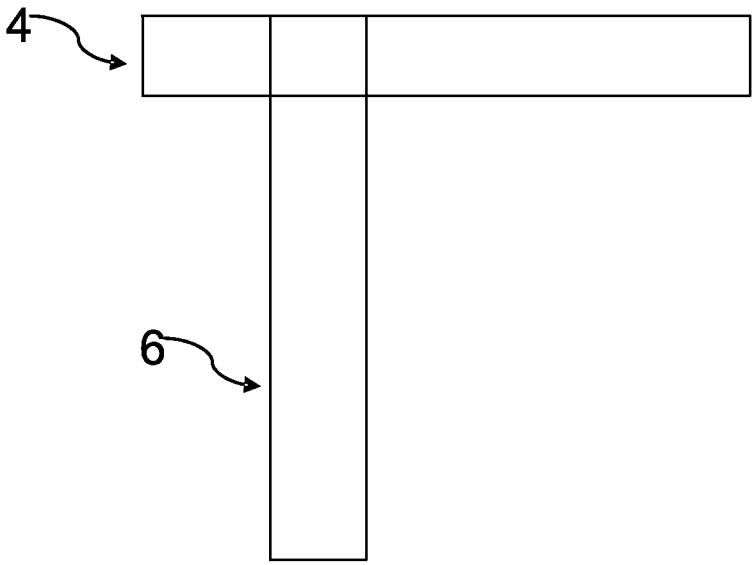
FIG. 3 shows a top view of another embodiment of the present invention.

Referring to FIG. 1, a side view of an embodiment of the present invention is shown. The training apparatus 2 comprises a sport-projectile stopping member 4 and an elongated body 6. The elongated body 6 has a first section 8, a second section 12, and a transition section 10 (i.e. the section of the elongated body 6 between the first section 8 and the second section 12), with a portion 9 of the first section 8 being positioned on the sport-projectile stopping member 4. In this embodiment, the elongated body 6 is substantially transverse to the sport-projectile stopping member 4 as best seen in FIG. 2. Furthermore, as shown in FIG. 2, the elongated body 6 is positioned at the center of the sport-projectile stopping member 2. However, it is appreciated that other configurations are possible to vary the difficulty and type of the training exercise. For example, as shown in FIG. 3, the elongated body 6 may be positioned closer to one side of the sport-projectile stopping member 4.

Referring again to FIG. 1, the first section 8 of the elongated body 6 is thinner in cross-section than the second section 12 of the elongated body 6. With these proportions, an orifice 14 is defined by the sport-projectile stopping member 4, the first section 8, the transition section 10 and the training surface 16. During the training exercise, a player may be required to slide a sport-projectile (e.g. a puck, a ball or a ringette ring) through the orifice 14. Further, the transition section 10 has an angular edge 17. The angular edge 17 may be varied to change the size of the orifice 14. For example, the angular edge 17 may be vertical to maximize the size of the orifice 14, while the angular edge 17 may be further slanted to reduce the size of the orifice 14.

As it will be further described below, the combination of the orifice 14, the sport-projectile stopping member 4, and a series of training apparatus provide for a unique training experience.

According to another embodiment of the present invention, an elevating member (not shown) may be included between the sport-projectile stopping member 4 and the portion 9 of the first section 8 of the elongated body 6. This allows the first section 8 of the elongated body 6 to be raised, thereby changing the size of the orifice 14. Furthermore, the slope of the elongated body 6 may be changed to increase the difficulty for the player jumping across the elongated body 6. The slope is the grade of the elongated body 6 with respect to the training surface 16. Alternatively, the elevating member may be a telescoping device embedded within the sport-projectile stopping member 4 and coupled to portion 9 of the first section 8 of the elongated member 6 such that extension of the telescoping device raises the first section 8 of the elongated member 6. The elevating member may be formed from a strong and hard substance such as an appropriate plastic and/or metal.

According to a further embodiment of the present invention, a hockey stick resembling member 20 may be coupled to the second section 12 of the elongated body 6. In this embodiment, the hockey stick resembling member 20 is able to turn such that its blade portion 22 can be in several positions on the training surface 16, ranging from either side of the elongated body 6. Furthermore, the hockey stick resembling member 20 may be made to move independently through a range of positions by the addition of a mechanism for rotating (not shown) the hockey stick resembling member 20. For example, the mechanism may be an electric motor and a power source (not shown) that may be embedded within the elongated member 6 such that the hockey stick resembling member 20 may continuously move through the range of positions.

Where the training surface 16 is an ice surface, the underside of the sport-projectile stopping member 4 may include at least one spike 24 to reduce the sliding of the training apparatus 2. Additionally, the second section 12 may include at least one spike 26 to further help reduce the sliding of the training apparatus 2.

Figure 4:
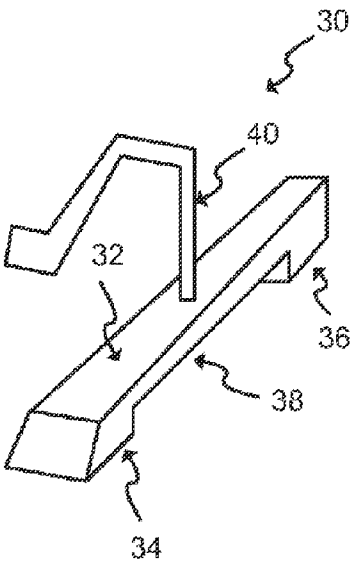
FIG. 4 is a perspective view of a set of training apparatus in accordance with a further embodiment of the present invention.
Figure 4:
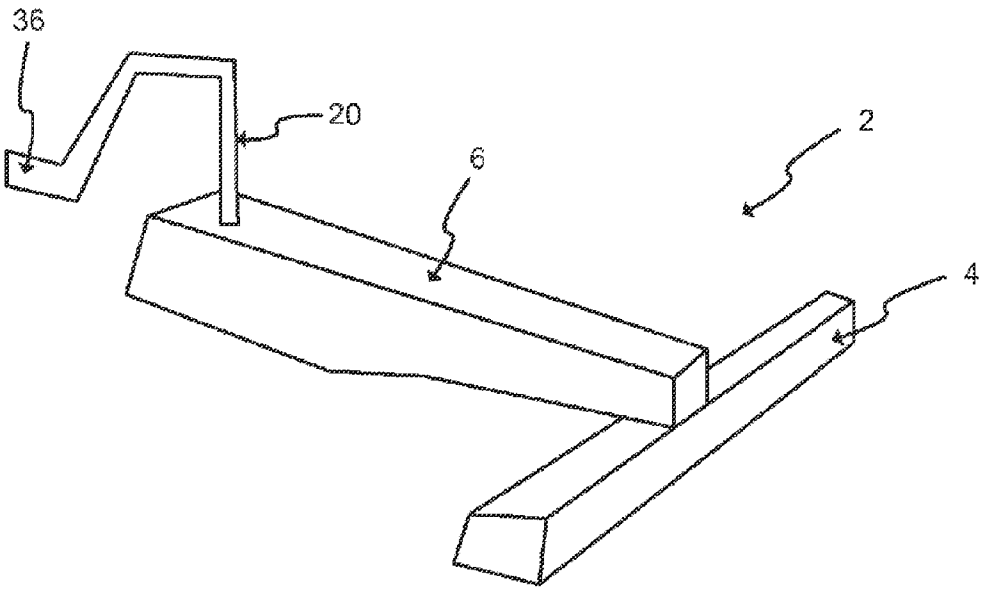

To further facilitate training of the player, a supplementary training apparatus 30 may be provided along with the training apparatus 2. The supplementary training apparatus 30, as shown in FIG. 4, includes an elongated body 32 having a first end 34 and a second end 36. Between the first and second ends 34, 36, an orifice 38 is provided. When the supplementary training apparatus 30 is placed on the training surface 16, the orifice 38 acts as a pass through for a sport-projectile (e.g. a puck, a ringette ring or a ball). To vary the difficulty of the training exercise, the elongate body 32 may include a first and second elevating member (not shown) on the underside of the first and second ends 34, 36 of the elongated body 32. In a further embodiment, a hockey stick resembling member 40 may be mounted on the elongated body 32. The hockey stick resembling member 40 may be rotatably mounted on the elongated body 32, at a position that is equidistant from the first and second ends 34, 36 of the elongated body 32. Furthermore, the hockey stick resembling member 40 may be made to move independently through a range of positions by the addition of a mechanism for rotating (not shown) the hockey stick resembling member 40. For example, the mechanism may be an electric motor and a power source (not shown) that may be embedded within the elongated member 32 such that the hockey stick resembling member 40 may continuously move through the range of positions.

Due to the nature of the use of the training apparatus 2 and the supplementary training apparatus 30, it may be advantageous for the training apparatus 2 and the supplementary training apparatus 30 to be made durable to withstand such things as skates sliding across the surfaces of both apparatus 2, 30 and players falling on both apparatus 2, 30. In accordance with an embodiment of the present invention, the sport-projectile stopping member 4 may be made by pouring a liquefied rubber and plastic mix into a mold. The mixture is then solidified into a component that is dense and durable to withstand the harsh training environment. The elongated body 6 of the training apparatus 2, the elongated body 32 of the supplementary training apparatus 30, and the hockey stick resembling member 20, 40 of the training apparatus 2 and supplementary training apparatus 40 may also be made using the same method.

Use of the Training Apparatus

In training, an embodiment of the training apparatus 2 and the supplementary training apparatus 30 may be used to improve agility, weight distribution and weight balancing for the player. The training exercise may incorporate a series of several training apparatus 2 and/or supplementary training apparatus 30 to vary the difficulty of the training exercise.

The following are specific uses of the training apparatus 2 and supplementary training apparatus 30 on ice surface. However, these specific uses only serve to illustrate example uses of the apparatus.

Crossovers

Crossover is a skill that is fundamental to a hockey or ringette player. Traditionally, players trained for crossover by weaving laterally across the skating surface through pylons or circles. However, by incorporating, for example, three or four of the training apparatus 2 in succession, it can provide a far more effective way of training for crossovers. In this way, the elongated body 6 of the training apparatus 2 is used as an obstacle for the player approaching the training apparatus 2 to jump over the elongated body 6. This requires the player to execute a strong push off the inside and outside edges of the skate to get over the elongated body 6, thereby helping players develop powerful pushes from both edges. This jumping exercise further helps the player correct his/her body positioning to achieve proper weight distribution and balance.

Moreover, the multiple training apparatus 2 may be arranged in various patterns to further add to the development of the player's edge control. The patterns may require the player to use deep edges and knee bends to initiate tight turns. Additionally, the player may be required to stick-handle a puck, a ball or a ringette ring and slide it through the orifice 14 without having the puck, ball or ring stopped by the sport-projectile stopping member 4. This further improves the agility and coordination of the player.

Backward Crossovers

While backward crossovers are important for all hockey and ringette players, it is critical for a defenseman. Defenseman must be able to crossover backwards while looking up the ice for an outlet pass, while maintaining puck or ringette ring control. A combination of one or several training apparatus 2 and supplementary training apparatus 30 may be used to train for backward crossovers.

As an example, the player may be required to skate forward toward a training apparatus 2. The player may then be required to change direction to jump over the training apparatus 2 backward while sliding the puck (or ringette ring or ball) through the orifice 14. This requires the player to execute and develop strong maneuverability skills, balance, weight distribution and agility. Depending on the subsequent skating pattern, the player may be required to quickly crossover and accelerate to the next training apparatus (i.e. second set of training apparatus 2 or supplementary training apparatus 30) to develop transitioning skills and "1st step" quickness.

Additionally, the training apparatus 2 and/or supplementary training apparatus 30 may include a hockey stick resembling member 20, 40 that is continually moving between a range of positions to mimic an opposing forechecker. This additional challenge may be incorporated to any type of training exercise as discussed herein.

Balance

To improve balance, the player may execute a "crossunder" while training with the training apparatus 2 and/or supplementary training apparatus 30. For example, as the player approaches forward to the training apparatus 2, he/she would have to execute a strong push off his/her skates to get over the training apparatus 2 with both feet. To get over the training apparatus 2, the player would have to swing the front foot (outside leg) over the training apparatus 2 that is behind his/her body. This requires the player to execute a lateral lean over the training apparatus 2 and land the outside skate on the skating surface, which becomes the "gripping edge" skate while the other skate becomes the "glide skate". In the same motion, the player would have to push off with the "gripping edge" and maintain the speed, puck (or ring or ball) control and balance to accelerate to the next apparatus in series on the skating surface. Balance and speed are lost if the player does not land smoothly on the "gripping skate". While the player is executing this maneuver, he/she would also have to lean over laterally on his/her inside skate edges, and simultaneously slide the puck (or ring or ball) through the orifice 14, without the puck (or ring or ball) getting stopped by the sport-projectile stopping member 4. While the player's upper body is leaning over the apparatus, the player improves balance and weight distribution. Furthermore, the lower body movement requires flexibility, lower body strength, and edge control.

Change of Direction

The ability to turn and change direction while maintaining speed and puck control is another desirable skill in hockey and ringette. To change direction quickly a player would have to develop balance, agility and maneuverability.

First, three or four iterations of an embodiment of the training apparatus 2 may be laid out in succession. The player may then be asked (by the trainer) to execute two or three crossovers over each of the training apparatus 2. The change of direction pattern requires the player to execute rapid leg movement and stick-handling through the successive first training apparatus 2 since he/she would have to change directions two or three times over the training apparatus 2. In addition to quickly turning and skating in the opposite direction, the player would have be able to rotate his/her upper body (waist through shoulders) through to the direction of travel. As the player trains this way with the training apparatus 2, he/she develops powerful cornering and transition skills.

This use of the training apparatus 2 also challenges the player to change from skating forward in one direction to skating backward in another direction and from skating backward in one direction to skating forward in another direction. To do this, the player would have to pivot forward and backward while maintaining puck control through the orifice 14 and through the hockey stick resembling members 20 of the training apparatus 2. All of the skating maneuvers through the training apparatus 2 are executed on the "edges" of the skates, helping the player develop edge control. The sharper or tighter the turn, the deeper the player's edge will have to be. Furthermore, on the last change of direction over the training apparatus 2, the player would be required to accelerate to the next apparatus. This helps the player develop 1st step quickness.

Agility, Edge Control and Puck (or Ring or Ball) Control

Agility is the mark of an elite player and the following uses of the training apparatus 2 and supplementary training apparatus 30 may improve the agility, edge control and puck (or ring or ball) control of the player.

A training apparatus 2 and a supplementary training apparatus 30 are laid out one after another, with the supplementary training apparatus 30 being further down the skating path than the training apparatus 2. There may be multiples of both apparatus 2, 30 in succession. The player then starts approximately 25-feet from the training apparatus 2. As the player approaches the training apparatus 2 at full speed, he/she executes a "spin-around move". The "spin-around move" involves making a 360-degree rotation facing away from the training apparatus 2. As the player skates away from the training apparatus 2, he/she is required to slide the puck, ball or ring through the orifice 14 between his/her feet. After executing the "spin-around move", the player crosses over the training apparatus 2 and retrieves the puck, ball or ring on the other side of the training apparatus 2. The player then changes direction and cuts in between the training apparatus 2 and supplementary training apparatus 30. As the player skates between the two apparatus 2, 30, he/she slides the puck, ball or ring through the orifice 38 of the supplementary training apparatus 30. The player proceeds to retrieve the puck, ball or ring and sprints to the next set of apparatus in succession.

This skating pattern trains the hockey or ringette player how to beat an opponent by spinning and placing the puck on the other side of the opponent, where the player can retrieve it. The rules of hockey do not allow the opponent to "impede" the player while they do not have the puck, so as long as they can learn how to "create space" and place the puck around the opponent, they cannot be checked or held back. Training with the apparatus 2, 30 develops these skills because the player learns the feeling of spinning with control and gains confidence while passing the puck through the orifice 14, 38 as they go over the apparatus 2, 30. The player further develops short explosive skating movements that encourage improved cornering power and quickness.

The player develops good hand-eye co-ordination, multi-tasking abilities and agility by making accurate passes through the orifice 14, 38 of the apparatus 2, 30 in the same motion as through the feet of an opponent. He/she also develops a powerful stride because of the "push off" power required on the inside and outside edges to get over the apparatus 2, 30 and reach the puck that is waiting or sliding, all in the same motion. Repetition of this maneuver helps the player perform quicker and faster moves, as well as develop strong balance on skates.

Alternatively, or additionally, the apparatus 2, 30 may be used with skating patterns designed to specifically train edge control and puck control. This can be done by placing the next set of apparatus 2, 30 perpendicular to the previous set of apparatus 2, 30, used with the skating pattern just described. Once the player reaches the second set of apparatus 2, 30, he/she must balance on his/her inside edges while skating around the perimeter of the second set of apparatus 2, 30. He/she must also perform accurate stick-handling maneuvers around the hockey stick resembling member 20, 40 and place the puck (or ring or ball) "under" or "over" the apparatus 2, 30, as directed by an instructor, while balancing on his/her edges around the second set of apparatus 2, 30. Once the player has completely circled the second set of apparatus 2, 30, he/she then accelerates with a strong push off the inside edge of the back skate, and outside edge of the inside skate, to go over the elongated body 6 of the training apparatus 2 of the second set of apparatus 2, 30. The player must also execute a strong lateral lean over the elongated body 6 for maximum power off the edges while he/she simultaneously slides the puck through the orifice 14 to the other side of the training apparatus 2 of the second set of apparatus 2, 30.

By using the apparatus 2, 30 in this way, the player develops agility, weight distribution, balance and quickness required to get over the apparatus 2, 30 and regain his/her stride as quickly as possible. The player also develops strong inside edge strength and co-ordination required to get around the hockey stick resembling members 20, 40 effectively. By skating over the elongated body 6 and landing to regain his/her stride as quickly as possible, the player trains balance, upper and lower body control, stability and puck control. This use of the apparatus 2, 30 is especially designed to help players improve in all of these areas, including "recovery". "Recovery" is a term used to describe the skill required by the player to land properly on the ice with control of the skate edges, body and feet. Good recovery allows the player not to lose speed and quickly transition into the next action. The player also learns that once they land after passing over the apparatus 2, 30, his/her blades must be in full contact with the ice, so that he/she has the necessary "edge grip" to push off again. He/she also improve his/her puck movement skills and stick-handling agility. Their confidence with the puck will subsequently improve.

Reaction Time

With all the training exercises described herein, the player is also able to develop quicker reaction time by attacking each apparatus 2, 30 at full speed. The training apparatus 2 and supplementary training apparatus 30 have limited space (i.e. the size of the orifice 14, 38) for the sport-projectile to pass through. From a distance, the orifice 14, 38 seems even smaller. Furthermore, the angular edge 17 of the training apparatus 2 further creates an impediment to the passage of the sport-projectile. Additionally, if the apparatus 2, 30 includes the hockey stick resembling member 20, 40, the player is presented with an additional challenge that he/she must adjust to as he/she approaches the apparatus 2, 30 at full speed. The addition of several apparatus 2, 30 in succession may also develop quick reaction time, especially if the successive apparatus 2, 30 are closely arranged.

Embodiments of a training apparatus 2 have been described above with reference to FIGS. 1-4. The training apparatus 2 comprises an orifice 14 defined by the sport-projectile stopping member 4, the first section 8, the transition section 10 and the training surface 16. As described above, the orifice 14 has a fixed size. As described further below, a further embodiment of a training apparatus may include a pass-under section having an adjustable size instead of, or in addition to, the fixed-sized orifice 14. The adjustable pass-under section may provide further uses for the training apparatus. As described further below, the adjustable pass-under section may provide a smaller opening to pass sport-projectile under in order to improve accuracy. Furthermore, the adjustable pass-under section may provide a surface to bounce the sport projectile off, providing greater flexibility in the use of the training apparatus by allowing the incorporation of passing drills that require bouncing the sport projectile of the surface covering the pass-under section.

Figure 5A:
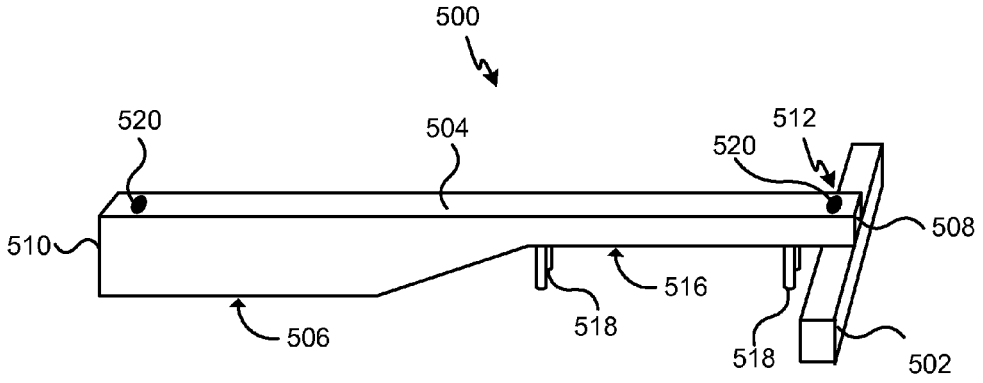
FIG. 5A is a perspective view of a further embodiment of a training apparatus.
Figure 5B:
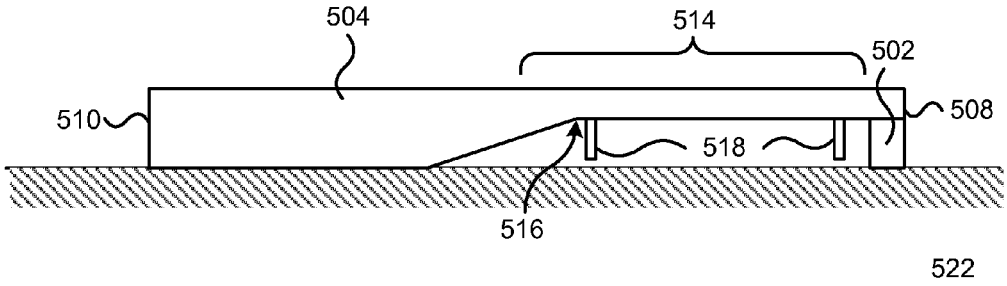
FIG. 5B is a side view of the training apparatus of FIG. 5A.
Figure 5C:
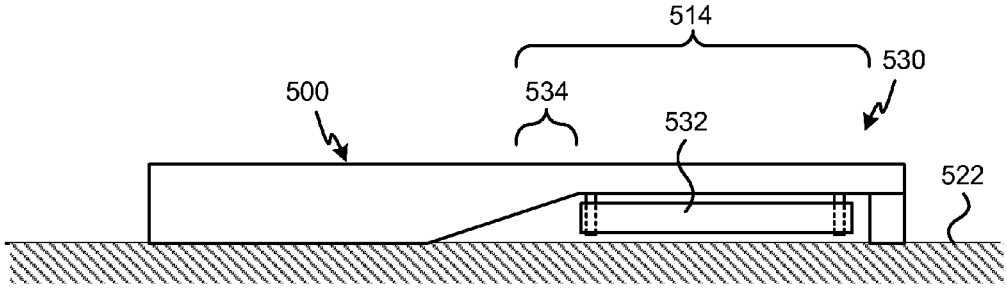
FIG. 5C is a side view of a training system incorporating the training apparatus of FIGS. 5A and 5B.

FIGS. 5A, 5B and 5C depict a further embodiment of a training apparatus. The training apparatus is similar to the training apparatus 2 described above and can be used in a similar manner as previously described. The training apparatus 500 comprises a support member 502 that supports an elongate member 504. The support member 502 may comprise a support member, or supporting surface, for supporting the member 502 on a surface 522. The support section may comprise a support surface on a lower surface that provides additional friction in order to keep the training apparatus 500 in place on the surface. The support section may comprise a spike or spikes that can be pushed into the surface 522 in order to more securely locate the training apparatus 500 on the surface. Although the support member 502 is depicted as having a lower surface located on the surface 522 along the entire length of the support member 502, one or more support sections may support the elongate member 504 above the surface 522 by a height sufficient to allow a sport projectile to pass under it.

The training apparatus 500 further includes an elongate member 504 that is arranged with the support section 502 when in use. The elongate member 504 comprises a first end 508 and a second end 510 opposite the first end. A first section 512 of the elongate member 504 is located proximate to the first end 508. The first section 512 of the elongate member 504 is coupled to the support section 502 when in use. The elongate member 504 and the support section 502 may be integrally formed as a single piece or may be formed as separate pieces that can be coupled together when in use. The elongate member 504 may further comprise a second support section proximate to the second end 510. The second support section may support the elongate member 504 on the surface 522. The second support section may comprise a support surface on a bottom surface 506 of the elongate member 504. The support surface may provide a high friction surface for preventing movement of the elongate member 504 during use. Additionally or alternatively the support surface may comprise a spike or plurality of spikes that can be pushed into the surface 522 to secure or help secure the position of the training apparatus. Although depicted as a part of the elongate member 504, the second support section of the obstacle member 504 may be provided in various ways, such as a post or pin that rests on the surface 522.

The training apparatus 500 further comprises a pass under section 514. The pass under section 514 is arranged between the first end 508 and the second end 510 of the elongate member 504 and is defined by a lower surface 516 of the elongate member 504 that is supported above the surface 522 by a height sufficient to allow a sport projectile to pass between the surface 522 and the lower surface 516 of the elongate member 504. As described above with regards to the orifice 14, the pass under section 514 allows a sport projectile to be passed under the elongate member 504 when in use, which may be used in various training exercises.

The training apparatus 500 may further comprise one or more accessory mounts 520 in an upper surface of the elongate member 504. The accessory mount 520 may be used to attach a training accessory, such as the hockey stick resembling member 20 described above, to the training apparatus 500. Alternatively, the training accessory may comprise a pair of spaced apart members in accordance with the sport the training apparatus is used for. For example, if the training apparatus is used for soccer, the training accessory may comprise a pair of spaced apart feet. The accessory mount or training apparatus 500 may be motorized to provide movement of the training accessory between a plurality of positions.

The training apparatus 500 further includes a mount, or as depicted a plurality of mounts 518, on the elongate member 504 for supporting an adjustment surface 532 as described further with reference to FIG. 5C. The mounts 518 are depicted as a plurality of posts that descend towards the surface 522 from the lower surface 516 of the elongate member 504. The mounts 518 can be used to support an adjustment surface 532 in the pass under section 514. When the adjustment surface 532 is supported in the pass under section 514 by the mounts 518, a useable length of the pass under section 514 is changed.

FIG. 5C depicts a side view of a training system. The training system 530 comprises a training apparatus 500 as described above as well as an adjustment surface 532 supported by the mounts 518 of the training apparatus 500. The adjustment surface 532 may be provided by a rubber band having a height sufficient to partially block the pass under section 514 in order to prevent the sport projectile from passing under the pass under section 514. The adjustment surface 532 may be provided on each side of the elongate member 504. The adjustment surface 532 may be wrapped around the four mounts 518 and supported on the mounts 518 by friction.

The adjustment surface 532, when supported by the mounts 518, blocks the pass under section 514 and changes a useable length 534 of the pass under section 514. The useable length 534 of the pass under section is the length of the pass under section 514 that a sport projectile can pass under. As depicted in FIG. 5C, the adjustment surface 532 blocks substantially all of the useable length of the pass under section 514, although it is contemplated that the mounts 518, or additional mounts, may be positioned to block less then all of the useable length of the pass under section 514. The training apparatus 500 is depicted as comprising four mounts 518; however, it is contemplated that additional mounts 518 may be provided in order to allow the useable length 534 of the pass under section 514 to be varied by supporting the adjustment surface 532 on various combinations of the mounts 518. By adjusting the useable length 534 of the pass under section 514, grater flexibility in the drills or exercises that may be performed using the training apparatus is provided. For example, if the useable length 534 is reduced, greater accuracy is required in order to successfully pass the sport projectile under the pass under section 514.

As described above, the adjustment surface 532 may be provided by a rubber band, or similar material, having a width sufficient to prevent a sport projectile from passing under the pass under section 514. The length of the rubber band, or the position of the mounts 518, may be varied in order to vary the tension of the rubber band when supported by the mounts. A higher tension may be used in order to provide a bounce-back effect when the sport projectile is bounced against the adjustment surface 532, possibly allowing the training system 530 to be used for passing drills. A lower tension may be used in order to provide a catching effect, effectively preventing, or reducing, the sport projectile from bouncing off the adjustment surface 532.

FIGS. 5A, 5B and 5C depict the mounts 518 as posts that extend from the lower surface 516 of the elongate member 504. These posts may be integrally formed or permanently affixed to the elongate member 504. Additionally or alternatively, the mounts may be provided in other ways. For example, the mounts may be provided by holes in the elongate member 504 that can receive posts, which may be secured in the mount by a friction fit. Additionally or alternatively, the mounts may comprise a threaded hole or nut affixed to the elongate member 504 and which can receive a threaded post for supporting the adjustment surface 532.

As will be appreciated, when the adjustment surface 532 is not supported in the pass under section 514 by the mounts 518, the training apparatus may be used in substantially the same manner as the training apparatus 2 described above. When the adjustment surface 532 is supported in the pass under section 514, the useable length 534 of the pass under section is changed providing flexibility in how the training system 530 may be used.

Figure 6A:
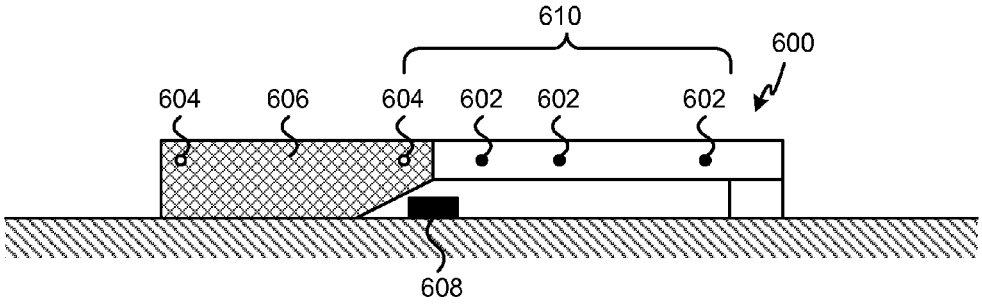
FIGS. 6A-6C are side views of a further embodiment of a training system.
Figure 6B:
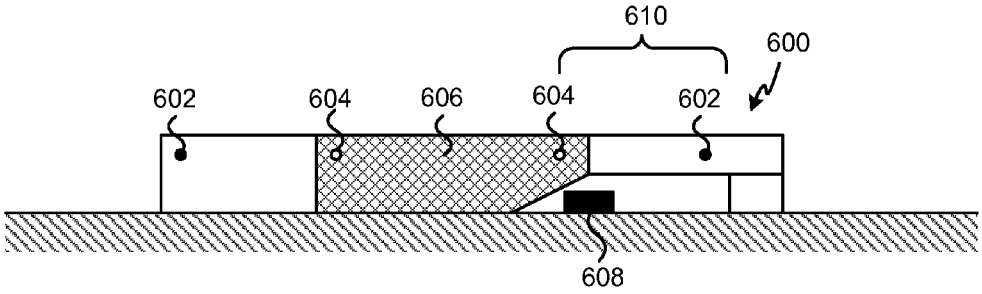
Figure 6C:
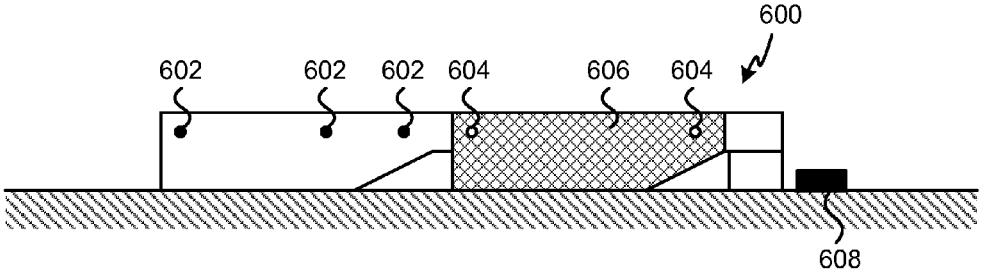

FIGS. 6A, 6B and 6C depict a further embodiment of a training system 600. The training system 600 is similar to the training system 530, and as such, only the differences will be further described. The training system 530 was described as having mounts 518 comprising posts extending from the lower surface of the elongate member 504 and that supported an adjustment surface 532 provided by a rubber band or similar material. In contrast, the training system 600 comprises an adjustment surface 606 made of a rigid material such as plastic, metal or wood. The training system 600 comprises a plurality of mounts 602, which are depicted as a holes in a side of the elongate member. The adjustment surface 606 may be supported by the mounts 602 by pins or posts 604 that are received by the holes of the mounts 602. A plurality of mounts 602 are depicted that allow the adjustment surface 606 to be supported in various locations. In FIG. 6A, the adjustment surface is supported in a position which does not block any of the pass under section, and as such the useable length 610 is equal to the pass under section. In FIG. 6B, the adjustment surface 606 is supported in a position which blocks a portion of the pass under section, providing a useable length 610 that is less then the pass under section, but still sufficient to allow a sport projectile 608 to pass under the pass under section. In FIG. 6C, the adjustment surface 606 is supported in a position that blocks substantially all of the pass under section, providing a useable length of essentially zero.

The mounts have been described as holes 602 which may receive a pin 604 in order to support the adjustment surface 606. It is contemplate that the mounts on the elongate member could comprise pins or protrusions that pass through corresponding holes in the adjustment surface 606.

Although the mounts have been described with reference to FIGS. 6A, 6B and 6C as being provided on a side of the elongate member, it is contemplated that other arrangement are possible. For example, the mounts could be provided on the support section, or on a top surface of the elongate member. Depending upon the location and arrangement of the mounts, the adjustment surface may need to be adapted from a flat panel as described to ensure that when it is supported by the mounts it changes a useable length of the pass under section. Further, separate adjustment surfaces may be provided on each side of the elongate member. Additionally or alternatively, the adjustment surface may have a U-shaped cross section with a width sufficient to straddle the elongate member. The U-shaped adjustment surface may be placed over the elongate member so that the arms of the U-shape project towards the surface and the joining web is supported by the top surface of the elongate member. Additional securing points may be used in order to secure the U-shaped adjustment surface in a particular position.

Figure 7:
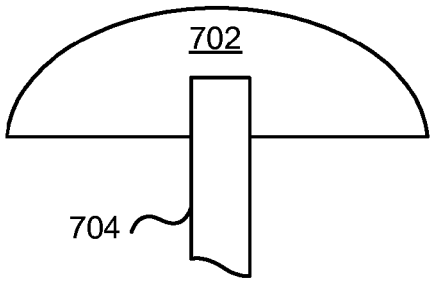
FIG. 7 is a top view of an embodiment of a support member.

FIG. 7 depicts in a top view a further embodiment of a support section. The support section may be used in place of the support section 502 of the training apparatus 500 or the sport projectile stopping member 4 of the training apparatus 2. The support section 502 and the sport-projectile stopping member 4 have been depicted as an elongated rectangular member. In contrast, the support section 702 has an arc-shaped side. It is contemplated that the support section or the sport projectile stopping member could have alternative shapes.

Figure 8:
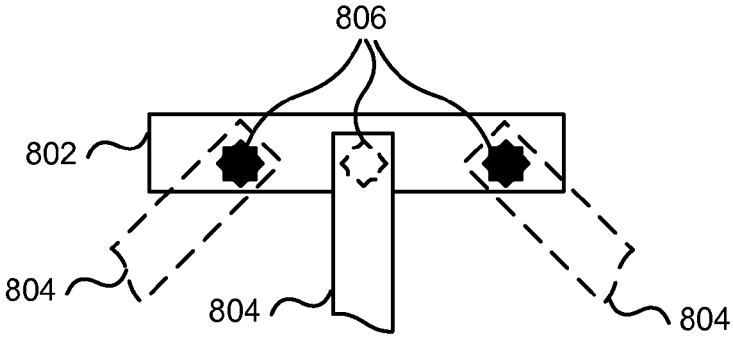
FIG. 8 is a top view of a further embodiment of a support member.

FIG. 8 depicts in a top view further embodiment of a support section. The support section 802 includes a plurality connection locations 806. The connection locations 806 are depicted as holes in the support section 802, which have a star shape in order to prevent unintended rotation of the elongate member. The elongate member 804 comprises a protrusion to be received within one of the connection locations 806. Although the connection locations 806 have been described as being holes, it is contemplated that the connection locations 806 could be provided by protrusions that are received within a corresponding hole of the elongate member 804. The connection locations 806 may be shaped to allow the elongate member 804 to be arranged at various angles to the support section 802. Further, although three connection locations 806 are depicted, it is contemplated that fewer or more connection locations could be provided. Alternatively, the elongate member could be coupled to the support section by way of a sliding connection, allowing the position of the elongate member to be adjusted relative to the support section.

Figure 9:
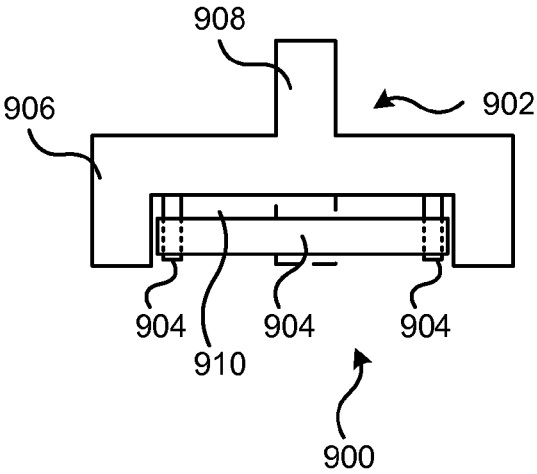
FIG. 9 depicts in a front view of a further embodiment of a training system.

FIG. 9 depicts in a front view of a further embodiment of a training system 900. The training system 900 comprises a training apparatus 902 that is similar to the training apparatuses described above as well as an additional adjustment surface 904. The training apparatus 902 comprises a support section 906 and an elongate member 908. The support section 906 and the elongate member 908 are depicted as being formed from a single piece of material. The support section 906 comprises an additional pass-under section 910 that is sized to allow a sport projectile to pass through when in use. The additional pass-under section 910 is described as being additional as it is considered that the elongate member 908 comprises one or more pass-under sections, each with possibly mounts supporting an adjustment surface.

The support section 906 comprises one or more additional mounts 912 for supporting the additional adjustment surface 904. The additional mounts 912 may comprises mounts as described above. The additional adjustment surface may be supported by the additional mounts 9112 to adjust a useable length of the additional pass-under section to provide flexibility in the drills that may be performed using the training system 900.

Figure 10A:
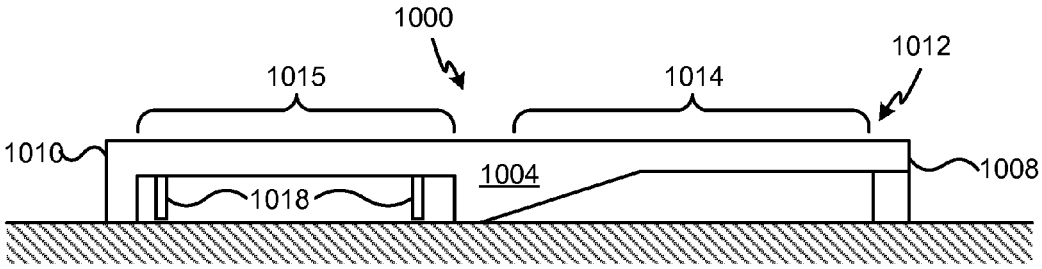
FIGS. 10A and 10B depict a further embodiment of a training system.
Figure 10B:
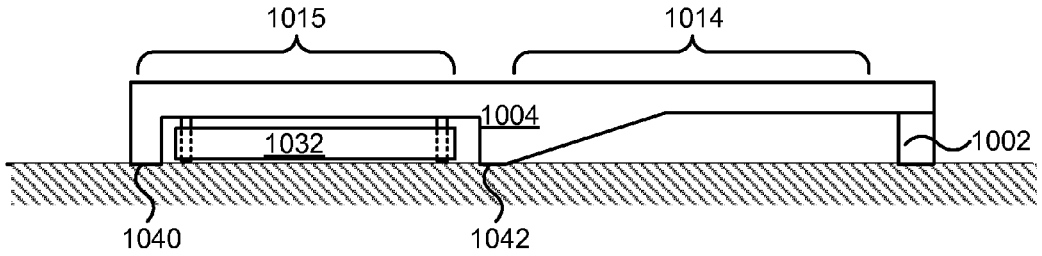

FIGS. 10A and 10B depict a further embodiment of a training system. As depicted, the training system 1000 is similar to the training system described above, however the training system 1000 comprises a plurality of pass-under sections 1014, 1015. The training system 1000 comprises a support section 1002 and an elongate member 1004. The elongate member 1004 has a first end 1008 and a second end 1010. The elongate member 1004 is supported at a first section 1012 by the support section 1002. The elongate member 1004 is also supported by a first support surface 1040 at the second end 1010 of the elongate member 1004. A second support surface 1042 is located in between the first support surface 1040 and the support section 1002.

As depicted, the training system 1000 comprises two pass-under sections 1014, 1015. The first pass-under section 1014 is depicted without any mounts for supporting an adjustment surface. The second pass-under section 1015 is depicted as having mounts 1018 for supporting an adjustment surface 1032. As will be appreciated, the second pass-under section 1015 may be blocked by the adjustment surface 1032 while the first pass-under section 1014 is not blocked. Having two pass-under sections 1014, 1015 provides greater flexibility in the drills or exercises that may be performed.

Training system 1000 comprises a plurality of pass-under sections 1014, 1015. The first pass-under section 1014, located at the front of the elongate member 1004, does not have any mounts for supporting an adjustment surface. The second pass-under section 1015, located between the first pass-under section 1014 and the second end 1010 of the elongate member 1010, is depicted as having mounts 1018 for supporting the adjustment surface 1032. It is contemplated that either one of the pass-under sections, or both could have mounts for supporting an adjustment surface. The adjustment surface may be provided by various materials, such as elastic, rubber, or plastic.

Figure 11A:
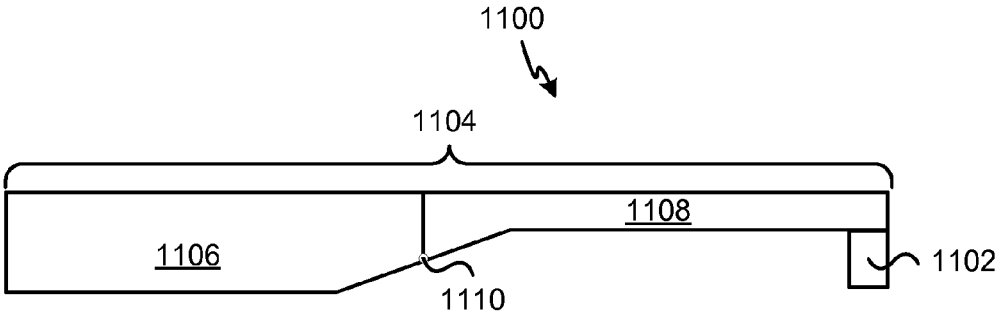
FIGS. 11A and 11B depict a further embodiment of a training apparatus.
Figure 11B:
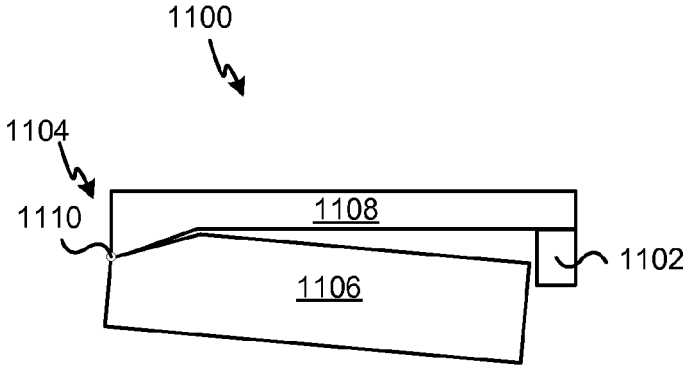

FIGS. 11A and 11B depict a further embodiment of a training apparatus 1100. The training apparatus 1100 is similar to those described above. The training apparatus 1100 includes a support section 1102 and an elongate member 1104. However, the elongate member 1104 is comprised of two member portions 1106, 1108 joined together by a pivot 1110. The pivot 1110 allows the elongate member 1104 to be folded as depicted in FIG. 11B to reduce the size of the training apparatus, which may be useful for transporting the training system 1100. Although depicted in a separate training apparatus, it is contemplated that the pivot 1110 may be incorporated into any of the embodiments described above.

Figure 12:
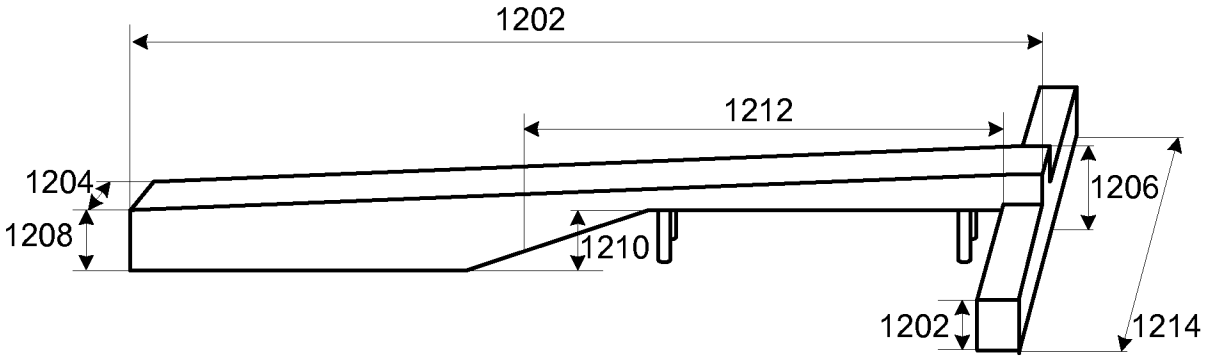
FIG. 12 depicts illustrative dimensions of a training apparatus used for hockey.

FIG. 12 depicts illustrative dimensions of a training apparatus used for hockey. For example, a training apparatus and systems for use in hockey may have varying lengths. An elongate member may have a length 1202 of approximately 6 feet and 3½ inches wide 1204. A top surface of the elongate member may be located approximately 7 inches above the surface at a first section 1206 and approximately 4 inches at a second section 1208. The pass-under section may be approximately 3 inches high 1210 and 3½ feet long 1212. A support section may be approximately 13 inches wide 1214 and 4 inches high 1216.

The dimensions of the training apparatus described above are only illustrative of one possible embodiment. As will be appreciated, the dimensions of a training apparatus and system may vary dependent upon the sport it is to be used for. For example, a training apparatus and system for use in training for hockey will likely have different dimensions than a training apparatus and system used in soccer training. Further, the dimensions of the training apparatus and system may vary even for use in training for the same sport. For example, various hockey training apparatuses and systems may be provided with varying lengths and heights.

Figure 13:
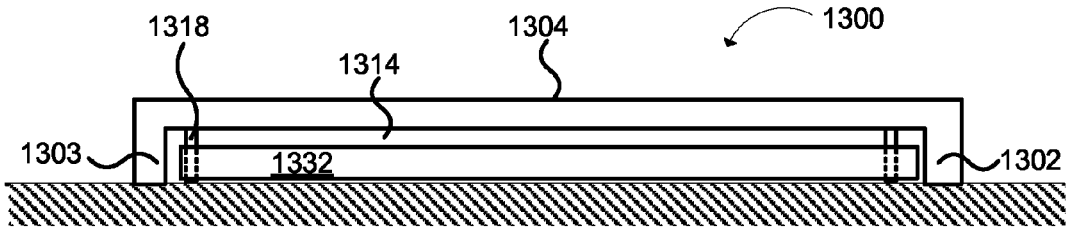
FIG. 13 depicts a further embodiment of a training apparatus.
Figure 14:
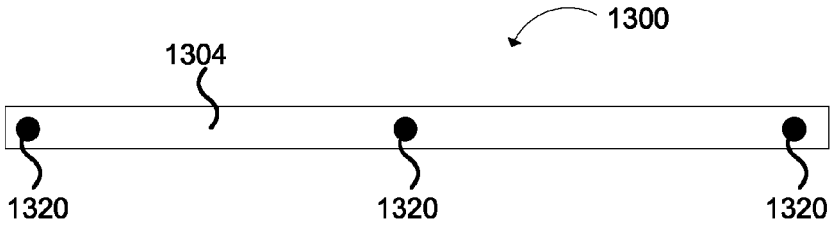
FIG. 14 depicts a top view of the training apparatus of FIG. 13.

FIG. 13 depicts a further embodiment of a training apparatus. FIG. 14 is a top view of the training apparatus of FIG. 13. The training apparatus 1300 comprises an elongate member 1304 supported above a surface by a first support section 1302 and a second support section 1303. The training apparatus 1300 comprises a pass-under section 1314. The training apparatus 1300 further comprises at least one mount 1318 for supporting an adjustment surface 1332 to adjust a useable length of the pass-under section 1314 that a sport projectile can pass under. In contrast to the training apparatuses described above, the support sections 1302, 1303 of the training apparatus 1300 are not elongate members that are arranged at an angle with the elongate member 1304. The elongate member 1304 may comprise one or more accessory mounts 1320 for mounting various accessories such as a hockey-stick accessory described above.

As will be appreciated, the training apparatus 1300 may be used in conjunction with one or more of the training apparatuses 500, 600, 1000, 1100, described above.

Figure 15:
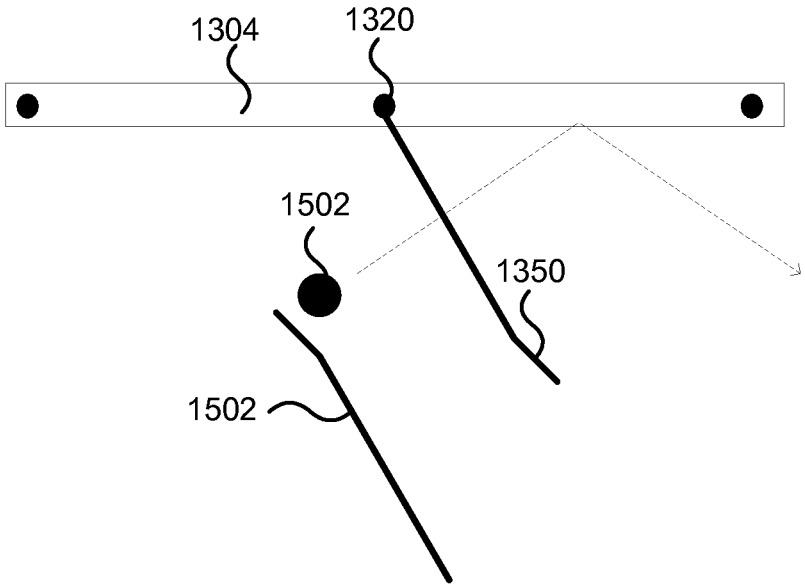
FIG. 15 to 17 depict uses of the training apparatus of FIG. 13.
Figure 16:
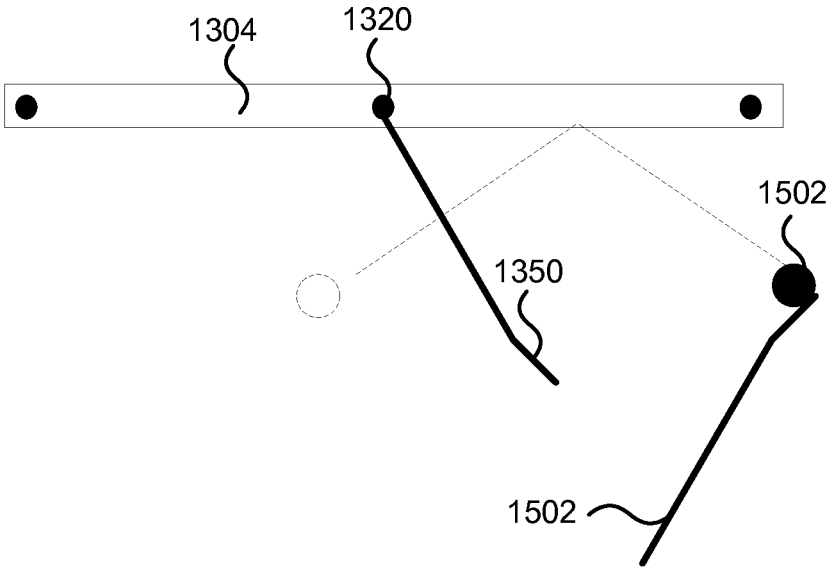
Figure 17:
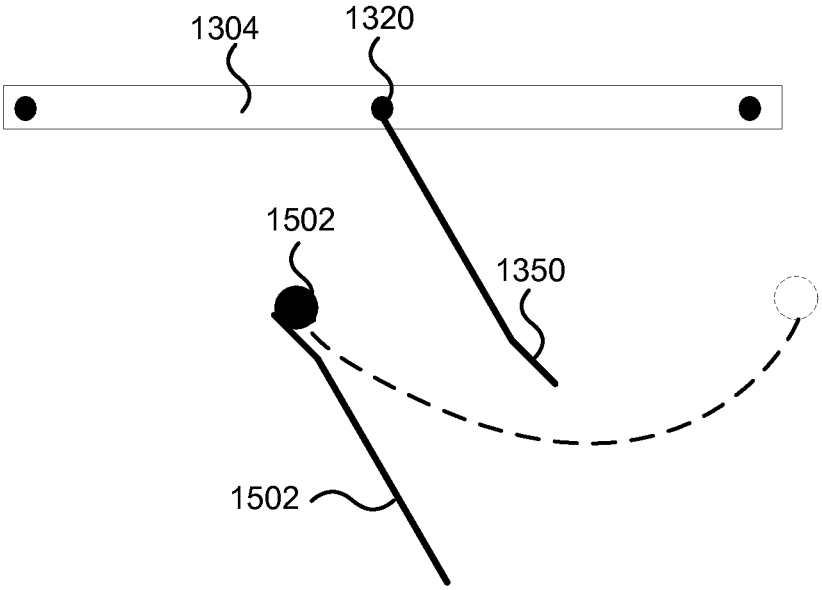

FIGS. 15 to 17 depict a use of the training apparatus of FIG. 13. The training apparatus 1300 in FIG. 15 includes a hockey stick accessory 1350 mounted to one of the accessory mounts 1320. A hockey player passes a puck 1502 from one side of the hockey stick accessory and bounces the puck off the adjustment surface 1332 of the training apparatus. The hockey player moves their stick 1504 to the opposite side to catch the puck as it bounces of the adjustment surface 1332 as depicted in FIG. 16. The hockey player then attempts to drag the puck around the hockey stick accessory back to the original starting position as depicted in FIG. 17.

It is contemplated that the training apparatus and system described above may be provided in a kit comprising the various components of the training apparatus, which may be integrally formed or provided as separate component, and one or more adjustment surfaces that can be supported by appropriate mounts.

Various embodiments of a training apparatus and system have been described by way of example. It is contemplated, although not explicitly described, that features described with regards to one or more particular embodiments can be incorporated into one or more other particular embodiments. Furthermore, it is contemplated that that various features of the different embodiments may be combined together to provide different training apparatuses and systems.

What is claimed is:

1. A training system comprising:

a support section for supporting a portion of the training system on a surface when in use; an elongate member arranged with the support section when in use, the elongate member comprising:

a first section proximate to a first end and coupled to the support section when in use;

a second end opposite the first end; and a pass-under section, arranged between the first end and the second end, defined by a lower surface of the elongate member supported above the surface by a height sufficient to allow a sport-projectile to pass between the surface and the lower surface of the elongate member when in use;

at least one mount located on the support section or the elongate member; and an adjustment surface removably supported under the pass-under section by the mount when in use, the adjustment surface, when supported by the mount, extending away from the lower surface towards the surface over at least a portion of the pass-under section and having a height sufficient to prevent the sport-projectile from passing under the adjustment surface within the pass-under section thereby reducing a usable length of the pass-under section that the sport-projectile may pass under.

2. The training system of claim 1, wherein the support section is provided by a support member arranged at an angle to the elongate member.

3. The training system of claim 2, wherein the support member has an elongated shape.

4. The training system of claim 2, wherein the support member has an arcuate surface away from the obstacle member.

5. The training system of claim 2, wherein at least a portion of the support member is supported above the surface by a height sufficient to allow a sport projectile to pass under to define a support pass-under section.

6. The training system of claim 5, further comprising at least one additional mount located to support an additional adjustment surface within the support pass-under section of the support member.

7. The training system of claim 1, wherein the support section comprises one or more of:

a high-friction surface;

a spike; and a pin.

8. The training system of claim 1, wherein the second end of the elongate member is supported above the surface.

9. The training system of claim 8, wherein the second end of the obstacle member is supported above the surface by one or more of:

a secondary support section;

a spike;

a pin; and a support surface.

10. The training system of claim 1, wherein the mount comprises one or more of:

a hole in the support section for receiving a corresponding post to support the adjustment surface;

a post projecting from the support section to support the adjustment surface;

a hole in the elongate member for receiving a corresponding post to support the adjustment surface;

a post projecting from the elongate member to support the adjustment surface; and a top surface of the elongate member comprising a hole to receive a corresponding post to secure the adjustment surface to the top surface; or a top surface of the elongate member comprising a post projecting from the top surface to secure the adjustment surface to the top surface.

11. The training system of claim 1, further comprising a plurality of mounts located on one or more of:

the elongate member; and the support section.

12. The training system of claim 1, wherein the elongate member is integrally formed with the support section.

13. The training system of claim 1, wherein the elongate member is removably coupled to the support section.

14. The training system of claim 13, wherein the elongate member may be coupled to the support section at one of a plurality of connection locations when in use.

15. The training system of claim 1, wherein the elongate member further comprises an additional pass-under section.

16. The training system of claim 15 further comprising at least one additional mount located on the support section or the elongate member for supporting an additional adjustment surface to change a usable length of the additional pass-under section that the sport-projectile may pass under.

17. A training system comprising:

a support section for supporting a portion of the training system on a surface when in use; an elongate member arranged with the support section when in use, the elongate member comprising:

a first section proximate to a first end and coupled to the support section when in use;

a second end opposite the first end; and a pass-under section, arranged between the first end and the second end, defined by a lower surface of the elongate member supported above the surface by a height sufficient to allow a sport-projectile to pass between the surface and the lower surface of the elongate member when in use;

at least one mount located on the support section or the elongate member;

an adjustment surface removably supported under the pass-under section by the mount when in use, the adjustment surface, when supported by the mount, extending away from the lower surface towards the surface over at least a portion of the pass-under section and having a height sufficient to prevent the sport-projectile from passing under the adjustment surface within the pass-under section thereby reducing a usable length of the pass-under section that the sport-projectile may pass under;

a stick member couplable to the elongate member, the stick member comprising:

an ascending portion, ascending from the elongate member when in use;

a descending portion, descending from the ascending portion towards the surface; and an obstacle portion at a lower section of the descending portion.

18. The training system of claim 17, wherein the stick member is rotatably couplable to the elongate member to allow a distance between the obstacle portion of the stick member and the adjustment surface to be adjusted.

19. A training system comprising:

a support section for supporting a portion of the training system on a surface when in use;

an elongate member arranged with the support section when in use, the elongate member comprising:

a first section proximate to a first end and coupled to the support section when in use;

a second end opposite the first end; and a pass-under section, arranged between the first end and the second end, defined by a lower surface of the elongate member supported above the surface by a height sufficient to allow a sport-projectile to pass between the surface and the lower surface of the elongate member when in use, wherein the support section is provided by a support member arranged at an angle to the elongate member;

at least one mount located on the support section or the elongate member;

an adjustment surface removably supported under the pass-under section by the mount when in use, the adjustment surface, when supported by the mount, extending away from the lower surface towards the surface over at least a portion of the pass-under section and having a height sufficient to prevent the sport-projectile from passing under the adjustment surface within the pass-under section thereby reducing a usable length of the pass-under section that the sport-projectile may pass under; and a secondary obstacle apparatus separate from the elongate member, the secondary obstacle apparatus comprising:

a secondary elongate member; and a secondary stick member couplable to the secondary elongate member.

20. The training system of claim 19, wherein the secondary obstacle apparatus comprises a pass under section and a mount for supporting an adjustment surface to change a useable length of the pass under section of the secondary obstacle apparatus.

21. The training system of claim 1, further comprising a secondary obstacle apparatus separate from the elongate member, the secondary obstacle apparatus comprising:

a secondary support section for supporting a portion of the secondary obstacle apparatus on the surface when in use; and a secondary elongate member arranged at an angle with the secondary support section when in use.

22. The training system of claim 21, wherein the secondary obstacle apparatus further comprises:

a secondary pass-under section of the secondary elongate member; and a secondary adjustment surface for adjusting a usable length of the secondary pass-under section.

23. A training system comprising:

a support section for supporting a portion of the training system on a surface when in use;

an elongate member arranged with the support section when in use, the elongate member comprising:

a first section proximate to a first end and coupled to the support section when in use;

a second end opposite the first end; and a pass-under section, arranged between the first end and the second end, defined by a lower surface of the elongate member supported above the surface by a height sufficient to allow a sport-projectile to pass between the surface and the lower surface of the elongate member when in use;

at least one mount located on the support section or the elongate member;

an adjustment surface removably supported under the pass-under section by the mount when in use, the adjustment surface, when supported by the mount, extending away from the lower surface towards the surface over at least a portion of the pass-under section and having a height sufficient to prevent the sport-projectile from passing under the adjustment surface within the pass-under section thereby reducing a usable length of the pass-under section that the sport-projectile may pass under;

a secondary obstacle apparatus separate from the elongate member, the secondary obstacle apparatus comprising:

a secondary support section for supporting a portion of the secondary obstacle apparatus on the surface when in use; and a secondary elongate member arranged at an angle with the secondary support section when in use; and a secondary stick member couplable to the secondary elongate member.

24. A training apparatus comprising:

a support member comprising a support for supporting the support member on a surface when in use;

an elongate obstacle member arranged with the support member when in use, the obstacle member comprising:

a first section proximate to a first end and coupled to the support member when in use;

a second end opposite the first end; and a pass-under section, arranged between the first end and the second end, defined by a lower surface of the obstacle member supported above the surface by a height sufficient to allow a sport-projectile to pass between the surface and the lower surface of the obstacle member when in use; and a mount located on the support member or the obstacle member for supporting an adjustment surface removably supported under the pass-under section by the mount when in use, said adjustment surface having a height sufficient to prevent the sport-projectile from passing under the adjustment surface within the pass-under section to thereby reduce a usable length of the pass-under section that the sport-projectile may pass under.

* * * * *